US006782890B2

(12) United States Patent
Barkmann et al.

(10) Patent No.: US 6,782,890 B2
(45) Date of Patent: Aug. 31, 2004

(54) APPARATUS FOR BUILDING TOBACCO RODS IN CIGARETTE MAKING MACHINES

(75) Inventors: Ralf Barkmann, Hamburg (DE); Rolf Lindemann, Glinde (DE); Reinhard Hoppe, Tespe (DE); Bernhard Jürgens, Wentorf (DE); Peter Schumacher, Elmshorn (DE); Manuel Hansch, Hamburg (DE)

(73) Assignee: Hauni Maschinenbau AG, Hamburg (DE)

( * ) Notice: Subject to any disclaimer, the term of this patent is extended or adjusted under 35 U.S.C. 154(b) by 14 days.

(21) Appl. No.: 10/213,433

(22) Filed: Aug. 7, 2002

(65) Prior Publication Data

US 2003/0034040 A1 Feb. 20, 2003

(30) Foreign Application Priority Data

Aug. 16, 2001 (DE) ..... 101 40 309
Nov. 8, 2001 (DE) ..... 101 54 807

(51) Int. Cl.[7] ..... A24C 5/39

(52) U.S. Cl. ..... 131/110; 131/109.3; 131/108; 131/84.3; 131/84.2

(58) Field of Search ..... 131/109.3, 108, 131/110, 84.3, 84.4, 84.2, 84.1, 109.2

(56) References Cited

U.S. PATENT DOCUMENTS

| | | | |
|---|---|---|---|
| 4,893,640 | A | 1/1990 | Heitmann et al. |
| 5,072,742 | A | 12/1991 | Heitmann |
| 5,526,826 | A | 6/1996 | Heitmann |
| 5,645,086 | A | 7/1997 | Brand et al. |
| 5,725,102 | A | 3/1998 | Gustavsson |

FOREIGN PATENT DOCUMENTS

| | | |
|---|---|---|
| DE | 198 40 143 | 3/2000 |

*Primary Examiner*—Dionne A. Walls
(74) *Attorney, Agent, or Firm*—Venable LLP; Robert Kinberg; Chad C. Anderson

(57) ABSTRACT

The distributor of a cigarette rod making machine employs a zig-zag sifter which receives a mixture of tobacco ribs and shreds from a reservoir by way of a duct or an elevator conveyor. The shreds leave the uppermost stage of the sifter and are conveyed, by a Coanda separator, into an upright gathering duct which discharges shreds for delivery onto the concave surface(s) of one or more guides serving to direct one or more streams of shreds against the underside(s) of one or more foraminous belt conveyors which advance the stream(s) past one or more trimming devices serving to remove the surplus and to thus convert each stream into a rod-like filler which is ready to be draped into a web of cigarette paper. The removed surplus is returned into the reservoir or directly into the zig-zag sifter.

19 Claims, 4 Drawing Sheets

D
64
16
1
66
14
26
2
4
28
27
29
32
3
31
8
6
41
13
11
39
7
36
17
9
34
19
12
33
52
44
43
23
46
47
38
18
21
22
63
48
51
49

APPARATUS FOR BUILDING TOBACCO RODS IN CIGARETTE MAKING MACHINES

CROSS-REFERENCE TO RELATED CASES

The present application claims the priorities of the commonly owned copending German patent applications Nos. 101 40 309.7 (filed Aug. 16, 2001) and 101 54 807.9 (filed Nov. 8, 2001). The disclosures of the above-referenced German patent applications, as well as those of each US and foreign patent and patent application identified in the specification of the present application, are incorporated herein by reference.

BACKGROUND OF THE INVENTION

The present invention relates to improvements in machines for making cigarettes, cigars, cigarillos and other smokers' products, particularly smokers' products of the type wherein a rod-like filler of smokable material is confined in a tubular wrapper of cigarette paper or the like. More particularly, the invention relates to improvements in apparatus for treating smokable material, such as a mixture of randomly distributed shredded tobacco leaf laminae (hereinafter called shreds and constituting the higher-quality fraction of comminuted tobacco leaves) and comminuted tobacco ribs, eyes and the like (hereinafter called ribs and constituting the less desirable fraction of comminuted tobacco leaves), prior to the making of the filler.

As a rule, the so-called distributor or hopper of a cigarette making machine receives batches of intermixed tobacco shreds and tobacco ribs and converts such batches into one or more streams or flows which consist primarily or mainly of shreds and contain more tobacco than necessary in a rod-like filler which is ready to be confined in a wrapper. The stream or streams is or are gathered on and are advanced by one or more foraminous belt conveyors which advances or ad-advance the stream(s) past one or more trimming or equalizing devices serving to remove the surplus. Each of thus trimmed streams or fillers is fed into a discrete wrapping mechanism which drapes the single trimmed filler or the respective trimmed filler into a running strip or web of wrapping material. Each of the thus obtained cigarette rods is severed to yield a sequence or file of discrete plain cigarettes of unit length or multiple unit length, and such cigarettes are fed into a packing machine or into a so-called tipping machine wherein the cigarettes (normally of multiple unit length) are united with filter mouthpieces of unit length or multiple unit length to form therewith filter cigarettes of unit length or multiple unit length.

The apparatus of the present invention is designed to treat a mixture of tobacco ribs and tobacco shreds in the distributor or hopper of a cigarette making, cigar making, cigarillo making or an analogous machine prior to conversion of the mixture into one or more streams which are fed to the trimming or equalizing device(s). As a rule, the mixture which enters into and moves in the distributor is treated and advanced by air in conjunction with implements and/or groups of implements including rotary brushes, so-called picker rollers, carded rollers, ducts, belt conveyors, plate-like guides, suction chambers, nozzles and the like. Reference may be had, for example, to commonly owned U.S. Pat. No. 5,645,086 granted Jul. 8, 1997 to Brand et al. for "APPARATUS FOR EVACUATING SURPLUS AIR FOR (sic!) THE DISTRIBUTOR OF A TOBACCO PROCESSING MACHINE". The manner in which one or more streams of smokable particles are treated after it issues or they issue from the distributor, and in which the trimmed off surplus is returned into the distributor, is disclosed, for example, in commonly owned U.S. Pat. No. 5,072,742 granted Dec. 17, 1991 to Heitmann for "METHOD OF AND APPARATUS FOR MAKING A FILLER OF SMOKABLE MATERIAL". Commonly owned U.S. Pat. No. 5,526,826 (granted Jun. 18, 1996 to Heitmann for "APPARATUS FOR REMOVING SURPLUS FROM A TOBACCO STREAM") discloses one presently preferred trimming or surplus removing device which converts a surplus-containing stream of tobacco particles into a rod-like filler which is ready to be draped into a continuous strip or web of cigarette paper or the like. A cigarette making machine with means for simultaneously trimming two streams of tobacco particles issuing from a distributor is disclosed, for example, in commonly owned U.S. Pat. No. 4,893,640 granted Jan. 16, 1990 to Heitmann et al. for "MULTIPLE-ROD CIGARETTE MAKING MACHINE".

A drawback of presently known machines for the making of cigarettes or the like is that they are too complex, too bulky or that they fail to produce tobacco streams which are of uniform quality, i.e., which can be converted into rod-shaped smokers' products meeting the highest and strictest requirements regarding the composition of their fillers such as the absence of ribs, the absence of unsatisfactory ribs, the absence of impurities, proper distribution of tobacco dust, uniform density, dense ends of the fillers at the lighted ends of cigarettes, cigars or cigarillos, absence of punctures (such as those caused by tobacco ribs) and the like. In other words, those parameters of the rod-like filler or fillers which are normally monitored by testing equipment in a cigarette making, cigar making or cigarillo making machine preparatory to and during advancement toward the conveyor(s) which gathers or gather the acceptable constituents of one or more streams of smokable material into one or more surplus-containing rod-like fillers should meet the strictest requirements for extended periods of time to thus reduce the percentage of rejects. This involves satisfactory sifting of the air-entrained tobacco shred—tobacco rib mixture preparatory to and during advancement toward the conveyor(s) which gathers or gather the acceptable constituents of one or more streams into one or more surplus-containing streams. Satisfactory regulation of the flow of air in the distributor is of particular importance in order to ensure segregation of any and all or of unacceptable ribs and/or other impurities and to otherwise manipulate the flow or flows of tobacco particles toward the trimming or surplus removing station (s).

OBJECTS OF THE INVENTION

An object of the instant invention is to provide a novel and improved distributor or hopper for use in or in conjunction with machines for making cigarettes or other smokable material containing commodities.

Another object of our invention is to provide a novel and improved tobacco conveying and classifying arrangement for use in the distributors of cigarette making and other machines for the conversion of mixtures of comminuted tobacco leaves into smokers' products.

A further object of this invention is to provide a novel and improved air circulating and recirculating arrangement for use in the distributors of cigarette making and analogous machines.

An additional object of the present invention is to provide a distributor which constitutes an improvement over and a further development of the distributors disclosed in U.S. Pat. No. 5,645,086 to Brand et al.

Still another object of this invention is to provide a novel and improved method of sifting, conveying and/or otherwise manipulating mixtures of tobacco shreds, tobacco ribs, tobacco dust and impurities in the distributor of a machine for making cigarettes or other smokers' products.

A further object of this invention is to provide a novel and improved method and a novel and improved combination of parts for segregating high-quality fragments of tobacco leaves, reconstituted tobacco and/or artificial tobacco from lower-quality fragments and/or impurities.

Another object of the invention is to provide a machine for making cigarettes or other smokers' products which includes or is associated with a distributor or hopper embodying the above-enumerated novel features and exhibiting important advantages over presently known machines and their distributors.

An additional object of our present invention is to provide a compact and relatively inexpensive long-lasting tobacco processing apparatus which can be combined with or incorporated in available machines for making cigarettes or other rod-shaped smokers' products.

Still another object of the present invention is to provide novel and improved means for sifting mixtures of high-quality or higher-quality and low-quality or lower-quality fragments of tobacco leaves, artificial tobacco and/or substitute tobacco in or ahead of cigarette making or analogous machines for the mass production of smokers' products.

A further object of the invention is to provide a distributor which can produce and deliver one or more unchanging or substantially unchanging streams or flows of high-quality particles of natural, substitute and/or reconstituted tobacco for long periods of time.

Another object of our invention is to provide a distributor or hopper which can be utilized with advantage in conjunction with or in machines for simultaneously making and processing several streams or flows of homogeneous comminuted smokable material.

SUMMARY OF THE INVENTION

One feature of the present invention resides in the provision of an apparatus known as distributor or hopper and serving to build at least one rod-like filler containing at least one constituent (e.g., shreds of tobacco leaf laminae) of a mixture of smokable particulate material (such mixture can contain shreds, fragments of tobacco ribs, so-called eyes and tobacco dust) and being pneumatically delivered to at least one foraminous conveyor (particularly to the underside of the at least substantially horizontal lower reach or stretch of an air-permeable belt conveyor, the lower reach being advanced below at least one suction chamber which attracts the at least one constituent of the mixture to the underside of the lower reach).

The improved apparatus comprises means for supplying the at least one constituent to the foraminous conveyor (such supplying means preferably comprises at least one guide having a preferably concave surface defining a path for advancement of the at least one constituent to the foraminous conveyor), a metering device which is arranged to supply the at least one constituent of the mixture into the aforementioned path, and a sifter which is arranged to supply the at least one constituent and air to the metering device.

The metering device can include an upright duct and the sifter preferably includes an at least substantially zig-zag-shaped sifter having a plurality of stages including a lowermost stage. Such zig-zag sifter preferably further includes or cooperates with a pneumatic follow-up sifter which is or can be installed beneath the lowermost stage of the zig-zag sifter. The follow-up sifter can include an air box and a sieve which separates the air box from the lowermost stage of the zig-zag sifter. Such apparatus can further comprise an air circulating system which is connected with the follow-up sifter and discharges air into the aforementioned path leading from the guide or guides to the foraminous conveyor(s).

The duct of the metering device can be provided with a vibrating outlet which is arranged to discharge the at least one constituent of the mixture for delivery into the aforementioned path, and at least one rotary withdrawing member which serves to direct the at least one constituent from the vibrating outlet into the path. Such apparatus preferably further comprises an air separator which is interposed between the sifter and the inlet of the duct. The separator can include or constitute a Coanda separator. As already mentioned hereinabove, the just described apparatus can comprise an air circulating system including a frequency-regulated transverse air stream generating blower; the sifter and the Coanda separator can constitute integral parts of such air circulating system. The latter is arranged to direct at least one stream of air in a predetermined direction and can further include an air bypass which is disposed downstream of the blower, as seen in the predetermined direction. Still further, the air circulating system can comprise an air-conveying elbow having radially inner and radially outer portions, and the air bypass preferably receives air from the radially outer portion of such elbow.

The zig-zag sifter can further comprise a rotary picker roller disposed opposite the follow-up sifter of the zig-zag sifter and serving to break up coherent accumulations, such as clumps (if any) of the mixture of smokable particulate materials which have entered the zig-zag sifter.

The metering device is preferably arranged to supply the at least one constituent of the mixture with a surplus which is removed at the at least one foraminous conveyor (e.g., in a manner as disclosed in the aforementioned U.S. Pat. No. 4,893,640 to Heitmann et al.). Such apparatus preferably further comprises a pneumatic return conduit which delivers the removed surplus into or close to the uppermost stage or section of the zig-zag sifter. The aforesaid air circulating system in the just discussed embodiment of the improved apparatus can further include an elbow and the pneumatic return conduit can receive air from the radially inner portion of the elbow.

The apparatus can further comprise a reservoir for the mixture of several constituents and a duct which leads from the reservoir downwardly to a median stage or section of the zig-zag sifter. A carded feeding roller is preferably provided to supply a continuous flow or batches of mixture from the reservoir into the inlet of the duct.

The rotational speed of the blower of the aforementioned air circulating system can be regulated in dependency upon changes of the pressure differential which exists between the uppermost and lowermost stages of the zig-zag sifter. The means for regulating the rotational speed of the blower can comprise a first signal generating pressure sensor at the level of or at a level above the uppermost stage of the zig-zag sifter, a second signal generating pressure sensor which is installed at the level of the lowermost stage of the zig-zag sifter, and means for comparing the signals from such sensors and for transmitting appropriate signals to the motor or another suitable prime mover which drives the blower.

The quantity of at least one constituent of smokable material in the metering device can be monitored by a suitable sensor which generates signals serving to regulate the rate at which the mixture of smokable constituents is being fed from the aforementioned magazine into the sifter (such as the aforementioned zig-zag sifter).

In accordance with a modification, and primarily in order to achieve savings in space, the means for supplying the mixture of smokable constituents to the zig-zag sifter comprises a so-called elevator conveyor which can include an endless belt or chain and rungs which transport batches of mixture from the magazine into the zig-zag sifter. The arrangement is preferably such that the elevator conveyor supplies the mixture into the zig-zag sifter at a level above the median portion of the latter. The metering device of such apparatus is or can be arranged to supply the at least one constituent with a surplus which is removed at the at least one foraminous conveyor; the means for returning the surplus to the magazine preferably includes one or more feed screws. Still further, such apparatus can comprise means for monitoring the quantity of the at least one constituent in the metering device and suitable means for driving the elevator conveyor at a speed which is a function of the monitored quantity of the at least one constituent in the metering device.

The novel features which are considered as characteristic of the invention are set forth in particular in the appended claims. The improved apparatus itself, however, both as to its construction and the modes of assembling and operating the same, together with numerous additional important and advantageous features and attributes thereof, will be best understood upon perusal of the following detailed description of certain presently preferred specific embodiments with reference to the accompanying drawing.

DESCRIPTION OF PREFERRED EMBODIMENTS

Figure 1:
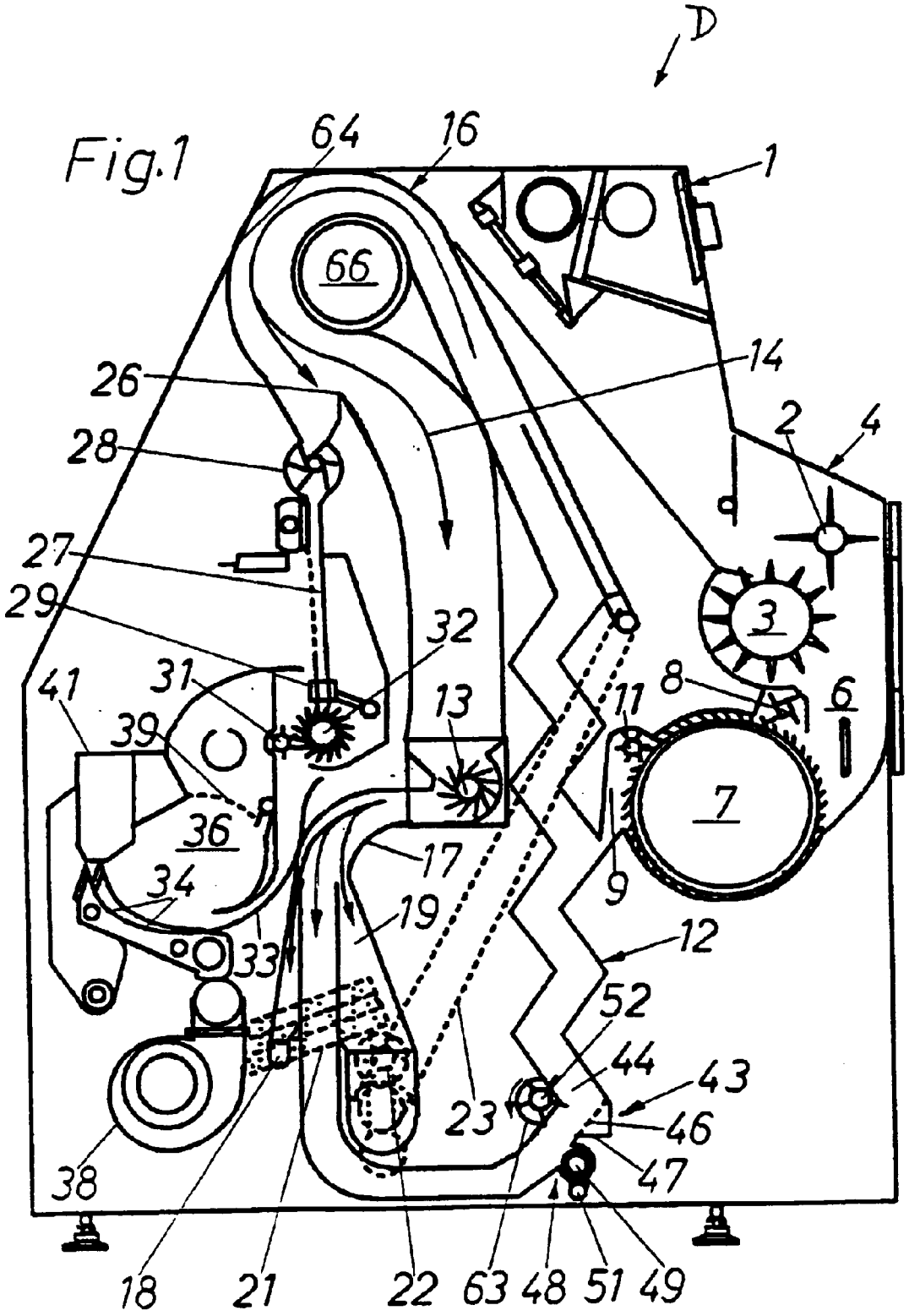
FIG. 1 is a schematic substantially vertical sectional view of an apparatus constituting a distributor or hopper and embodying one form of the present invention, the distributor being incorporated into a cigarette making machine.
Figure 2:
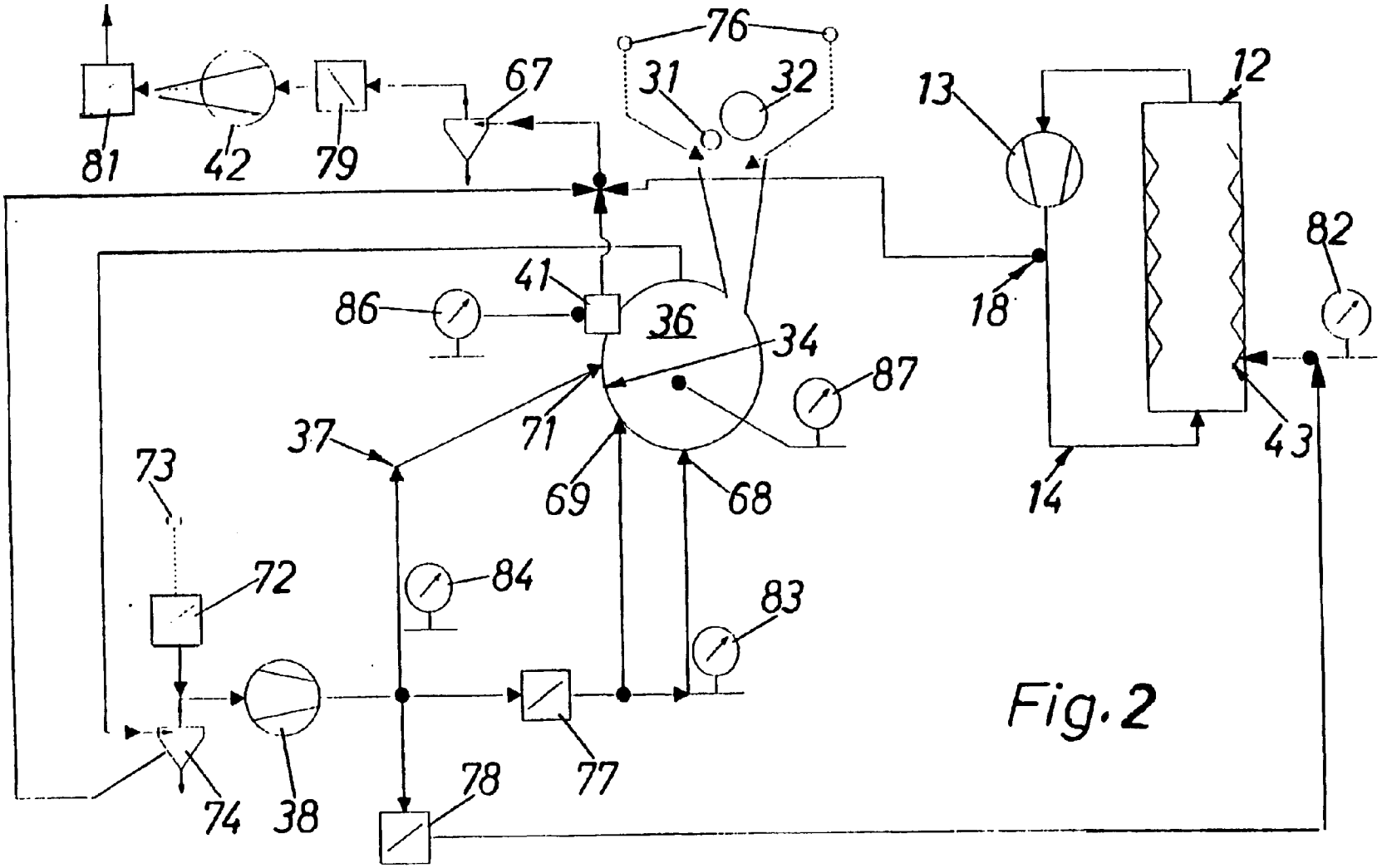
FIG. 2 is a diagram of the air circulating system in the distributor of FIG. 1.

FIG. 1 shows a distributor or hopper D (hereinafter called distributor) which forms part of or is combined with a cigarette rod making machine including a stream building unit employing two endless foraminous belt conveyors 41 (only one shown in each of FIGS. 1 and 2). Each conveyor 41 has a lower reach or stretch disposed below a suction chamber which attracts a discrete stream of tobacco particles. The streams contain tobacco particles in excess of those required in the rod-like fillers which are to be wrapped in webs of cigarette paper or the like. The present invention is concerned with the treatment of tobacco particles before they reach the respective conveyors 41. These conveyors can be of the type disclosed, for example, in the aforementioned U.S. Pat. No. 4,893,640 to Heitmann et al. wherein FIG. 2 shows two endless foraminous belt conveyors 1 and 2 having lower reaches advancing beneath discrete suction chambers 6, 7 to build up two discrete tobacco streams each of which contains a surplus of smokable material.

The distributor D serves to treat tobacco particles which issue from a suitable source (not shown), such as a shredder of tobacco leaves, and are converted into two continuous streams, one for each of the belt conveyors 41. This distributor includes a pneumatically operated gate 1 which can be said to form part of the aforementioned source of a mixture of tobacco particles and serves to deliver successive batches or a continuous flow of a mixture of tobacco shreds and fragments of tobacco ribs into a preliminary distributor or hopper 4 (hereinafter called hopper to distinguish from the distributor D) having rotary rakes 2, 3 which cooperate to feed the mixture into a tobacco reservoir or magazine 6.

The outlet of the reservoir 6 is adjacent a carded feeding roller 7 which cooperates with a rotary paddle wheel 8 serving to remove the surplus off the carding of the roller 7 so that the latter withdraws from the reservoir 6 an at least substantially uniform layer of tobacco particles. Successive increments of such layer are expelled from the carding of the roller 7 by a rapidly rotated singularizing roller 11 which propels the tobacco particles into a downwardly sloping feeding duct 9 discharging into the median portion or region of a sifting unit 12 here shown as an at least substantially vertical (upright) zig-zag sifter constituting a desirable novel feature of the distributor D and having a plurality of communicating sifting sections or stages.

The zig-zag sifter 12 constitutes a component of a first air circulating system 14 (see also FIG. 2) which further employs a transverse air stream generating blower 13. This blower is disposed upstream of a bent pipe or elbow 17 (i.e., ahead of the elbow as seen in the direction of circulation of air in the system 14). The radially outer portion of the elbow 17 has an outlet which discharges into a bypass 18, and the radially inner portion of the elbow communicates with an overflow conveying channel 19. The latter is connected with the outlet of a tobacco surplus transporting device including at least one feed screw 21 and at least one cell wheel 22. The outlet of the channel 19 delivers surplus tobacco into a return conduit 23 which discharges into the uppermost section or stage of the sifter 12 in the first air circulating system 14.

The distributor D further comprises a tobacco/air separator 16 which is integrated into the air circulating system 14 and constitutes a Coanda separator, i.e., a separator the operation of which involves reliance upon the tendency of a gas or liquid coming out of a jet to travel close to the wall contour even if the wall's direction of curvature is away from the jet's axis. Reference may be had, for example, to McGraw-Hill DICTIONARY OF SCIENTIFIC AND TECHNICAL TERMS (Third Edition) published by McGraw-Hill Book Company. The separator 16 includes a segregating edge 26 disposed between the suction intake of the blower 13 and a cell wheel gate 28 which is installed at a level above a metering device employing a gathering duct 27.

The duct 27 is at least substantially upright and its lower end portion 29 constitutes a vibratory outlet which is located above a withdrawing or evacuating roller 32 cooperating with an expelling roller or paddle wheel 31. The evacuating roller 32 is installed above a guide channel which is bounded from below by an arcuate guide 33 merging into a twin-track flow guiding member 34 defining paths for two offset streams of tobacco particles which advance toward the respective foraminous belt conveyors 41. The flow guiding member 34 is adjacent the lower portion of a rolling chamber or compartment 36.

As shown in FIG. 2, the compartment 36 is integrated into a second air circulating system 37 which further includes a blower 38 serving to establish a flow of tobacco-conveying air which advances closely adjacent to the concave side of the flow guiding member 34. The rolling chamber 36 can communicate with the atmosphere by way of perforations or interstices in the sieve-like cover or lid 39. The flow guiding member 34 causes the two tobacco-air mixtures to advance upwardly from the level of the discharge end of the guide 33 to the undersides of the lower reaches of the foraminous belt conveyors 41 which advance the two flows into the ranges of the respective surplus-removing trimming or equalizing devices such as those disclosed in the aforementioned U.S. Pat. No. 4,893,640 to Heitmann et al. FIG. 2 shows a blower 42 which causes air to flow upwardly through the lower reaches of the foraminous belt conveyors 41 and to thus advance the two tobacco streams toward the respective surplus removing devices.

The zig-zag sifter 12 includes a pneumatic follow-up sifter 43 which is installed adjacent to and communicates with the lowermost stage 44 of the sifter 12. The follow-up sifter 43 includes an air box 47 surrounded by a sieve 46. As shown in FIG. 2, the follow-up sifter 43 is connected with the pressure side of the second air circulating system 37 which, as already explained hereinbefore, supplies air to the flow guiding member 34 below the rolling chamber or compartment 36.

In order to compensate for sifting air being additionally admitted into the air circulating system 14 and to thus establish an air balance, the bypass 18 is connected with the suction intake of the aforementioned blower 42 for the foraminous belt conveyors 41.

Figure 3:
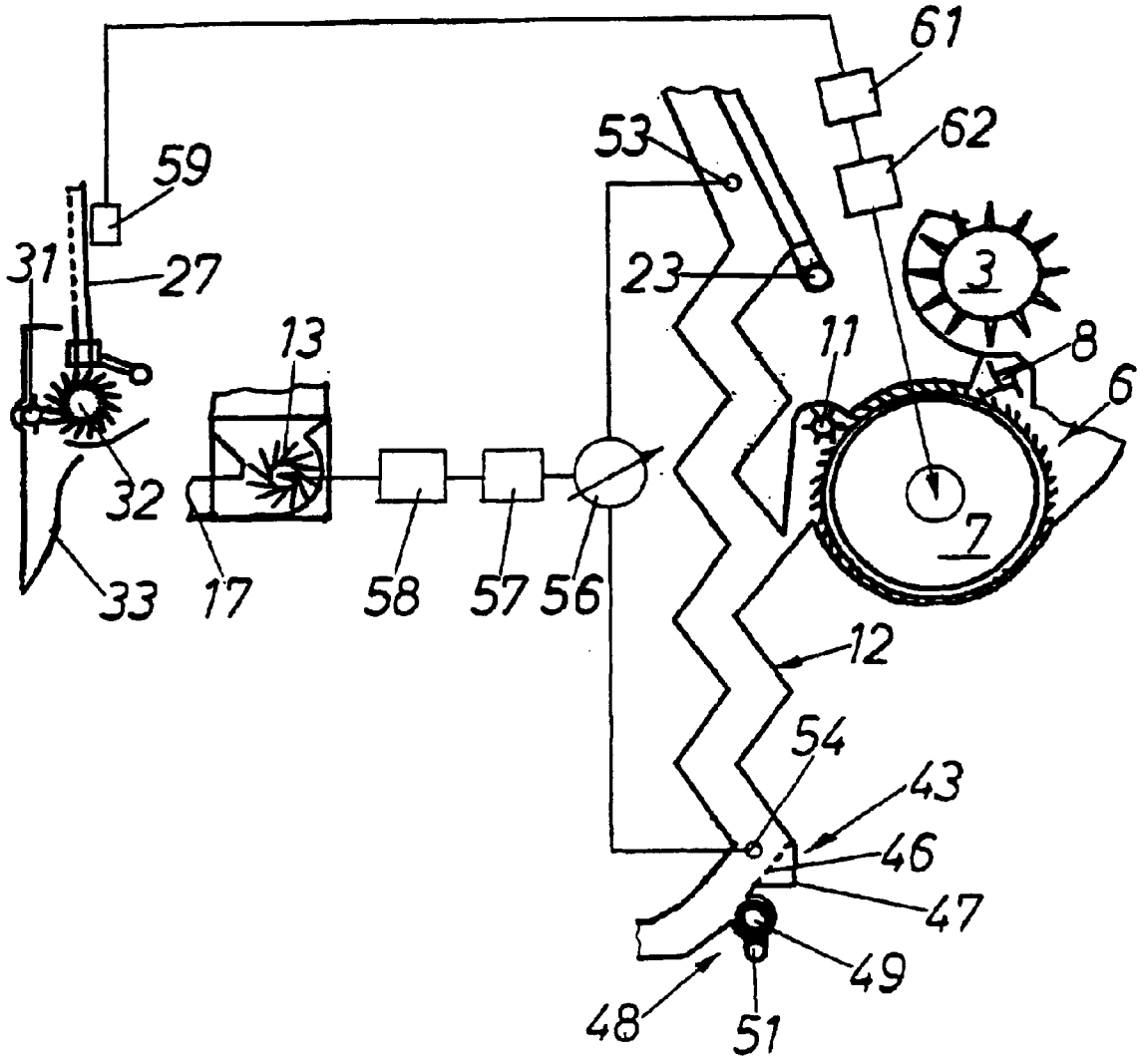
FIG. 3 illustrates certain details of the means for monitoring and regulating the operation of several component parts of the distributor which is shown in FIG. 1.

The pneumatic follow-up sifter 43 is located at a level above a withdrawing or evacuating system 48 which comprises a feed screw 49 and a cell wheel gate 51. The follow-up sifter 43 confronts the lowermost stage 44 of the zig-zag sifter 12 and the latter is provided with a rotary picker roller 52 which is adjacent the follow-up sifter 43. In order to detect eventual disturbances (such as choking, wrong setting and/or others) in the sifter 12, there is provided a pressure differential monitoring assembly which is shown in FIG. 3 and includes pressure monitoring devices 53 and 54 respectively installed in or at the upper and lower ends of the sifter 12. These sensors transmit signals to a pressure differential measuring instrument 56. In order to allow for correction of sifting parameters, there is provided a control unit 57 which regulates the operation of a motor 58 serving to increase or reduce the RPM of the transverse stream generating blower 13.

A conventional sensor unit 59 is utilized to monitor the level of tobacco in the gathering duct 27 of the metering device and to transmit signals to a control unit 61 which can start a motor 62 serving to correct the RPM of the feeding or admitting roller 7 when the level of tobacco in the duct 27 changes. As already explained hereinbefore, the roller 7 serves to admit tobacco into a median stage of the zig-zag sifter 12 by way of the singularizing roller 11 and duct 9.

The operation of the distributor D is as follows:

The gate 1 delivers a mixture of tobacco ribs and tobacco shreds into the range of cooperating rotary rakes 2 and 3 in the hopper 4 for delivery into the reservoir 6. Such mixture normally contains tobacco and even some other particulate material (impurities) such as particles of metal, soil or the like. The steep advancing combs or carding of the roller 7 draw or draws the mixture from the supply in the lower part of the reservoir 6 and cooperate or cooperates with the paddle wheel 8 to deliver a more or less uniform layer of the mixture into the range of the rotating singularizing roller 11 which propels the loosened mixture of tobacco shreds and ribs into the feeding duct 9 for delivery into a median stage or section of the zig-zag sifter 12.

The distributor D preferably comprises a device (not shown) which monitors the RPM of the feeding roller 7 and/or the wheel 8 and causes a stoppage of the drive means 62 for the part 7 and/or 8 and/or for the entire distributor D when the RPM drops below a threshold value which is indicative of a jam at the outlet of the reservoir 6, e.g., by a bulky or hard foreign object which could cause extensive damage if allowed to enter the zig-zag sifter 12 and the parts downstream of this sifter.

The roller 11 effects an acceleration and resulting coarse preliminary singularization of the delivered mixture of ribs and shreds. The rotational speed of this roller is preferably selected in such a way that the particles of the mixture which is removed by its pins from the carding of the roller 7 are not subjected to excessive destruction (such as breaking of the shreds and/or the generation of excessive quantities of dust) but that the mixture is subjected to a pronounced singularization, i.e., separation of shreds from each other and from the ribs as well as separation of the ribs from each other. It has been ascertained that a highly satisfactory mechanical singularization of the particles of the mixture advancing from the reservoir 6 into the feeding duct 9 can be achieved if the roller 11 is driven at between 800 and 900 revolutions per minute.

A desirable feature of the configuration and orientation of the zig-zag sifter 12 is that the light-weight tobacco shreds are caused to rise while the tobacco stream is set in motion in a direction transversely of the main stream. Since the flow profile is pronouncedly non-homogeneous, the air in the sifter 12 includes high- and low-velocity zones which cause the particles of tobacco to carry out a circulatory movement, namely to form so-called eddying rolls. This causes the ribs of the mixture of ribs and shreds being delivered by the feeding duct 9 to become separated from the shreds and to descend by gravity through successive zig and zag stages or sections of the lower part of the sifter 12 toward the pneumatic follow-up sifter 43. The lighter particles (primarily shreds) rise with the ascending air flow through successive stages of the upper part of the sifter 12. Segregation of ascending shreds from those ribs which happen to rise above the discharge end of the feeding duct 9 proceeds from stage to stage of the sifter 12, and the thus segregated additional ribs (if any) descend by gravity toward the follow-up sifter 43.

The ribs which descend (in the sifter 12) into the range of the sifter 43 are removed from the path defined by the zig-zag sifter 12 by the follow-up sifter 43 with assistance from air being branched off the second air circulating system 37; such branched off air causes lighter particles (such as dust and/or shreds) which adhere to some ribs descending by gravity in the lower part of the sifter 12 to rise toward and into the upper part of the latter to thus further enhance the quality of the sifting action which is being carried out by the novel unit 12.

The rotary picker roller 52 at or close to the level of the follow-up sifter 43 serves to break up eventual accumulations (such as clumps) of coherent lighter and/or heavier tobacco particles and to thus facilitate the aforediscussed shred-lifting action of air which is branched out of the second air circulating system 37 and serves to lift the shreds in the sifter 12 toward and beyond the outlet of the feeding duct 9. The pins or needles of the picker roller 52 engage adjacent tobacco particles (including clumps, if any) and move them along the concave inner side of the adjacent shroud 63. The roller 52 rotates in a counterclockwise direction, as viewed in FIG. 1, and advances the clumps along the inner side of the shroud 63 with the resulting breaking up of the clumps and reintroduction of their constituents into the adjacent portion of the sifter 12.

The ribs which ultimately leave the sifter 12 enter the feed screw 49 of the withdrawing or evacuating system 48; this feed screw advances the ribs transversely of the plane of FIG. 1 across the full width of the distributor D and to the cell wheel gate 51 therebelow.

The shreds which are separated from all undesirable parts (including the non-acceptable ribs) are mixed with surplus tobacco which was removed from the tobacco streams being advanced by the foraminous belt conveyors 41 and is admixed to the shreds by the return conduit 23 at the upper end of the zig-zag sifter 12. The trimmed-off surplus tobacco is admitted into the return conduit 23 by the feed screws 21. In accordance with a feature of the present invention, such surplus tobacco is transferred from the feed screws 21 into the cell wheel 22 to enter the air stream being supplied by the first air circulating system 14 by way of the overflow conveying channel 19 and to be conveyed into the return conduit 23.

The mixture of shreds which have risen in the sifter 12 into its upper end portion and of returned surplus tobacco which was removed by the trimming devices from the streams being delivered by the foraminous belt conveyors 41 enters the separator 16 wherein air is separated from tobacco under the influence of centrifugal force and by the Coanda effect. Thus, the shreds are being acted upon by centrifugal force to advance in the radially outer portion 64 of the separator 16. The air is subjected to the Coanda effect and flows along the cylindrical radially inner portion of the separator 16, namely in a tubular body 66. The edge 26 effects the ultimate separation of air from tobacco shreds, and the thus separated air enters the transverse stream generating blower 13 which exhibits a uniform flow profile, i.e., a homogeneous velocity distribution as seen transversely of the distributor D (namely at right angles to the plane of FIG. 1).

That portion of the circulating air and sifting air which flows at the pressure side of the transverse stream generating blower 13 at the radially outer wall of the elbow 17 is drawn off to flow into the bypass 18 and serves as a means to compensate for possible leakages as well as to establish a correct air balance within the sifter system. This is accomplished in that the quantity of withdrawn air matches the quantity of air which is admitted to the sifting system by the follow-up sifter 43. Such mode of operation brings about the additional advantage that the thus tapped air contains a high concentration of tobacco dust which is entrained with air and thus prevents the establishment of a dust-enriched flow of air and tobacco shreds and ribs in the sifter circuit of the distributor D.

A portion of the tapped air stream which is enriched with tobacco dust is separated due to the provision of a connection between the bypass conduit 18 to an axial cyclone 67 (see FIG. 2) of the suction stream circuit which is operated by the blower 42, and the reusable particles of tobacco dust are returned into the distributor D (e.g., into the reservoir 6) in a manner not shown in the drawing.

Tobacco which is separated from air in the tobacco-air (Coanda) separator 16 is caused to pass through the cell wheel gate 28 and to thus leave the sifting system. Such separated tobacco is caused to enter the gathering duct 27 of the metering device in a conventional manner, and the rollers 31, 32 withdraw finely distributed tobacco particles from the duct 27 to advance such particles along the concave surface of the arcuate guide 33 and thereupon along the channeled concave upper side of the flow guide 34 beneath the chamber or compartment 36. FIG. 2 shows that the part 34 is provided with nozzles having orifices 68, 69 and 71 for the discharge of compressed air from the second air circulating system 37. This ensures that the pressure at the concave side of the flow guide 34 is maintained at an optimal (ideal) value, preferably at slightly below atmospheric pressure such as close to 0 mb. This induces the flow of two tobacco streams (predominantly tobacco shreds) which closely follow the guide 34 and advance toward the undersides of lower reaches of the foraminous belt conveyors 41.

The heights of the tobacco streams on the guide 34 and/or at the undersides of the belt conveyors 41 are monitored (the monitoring means are not shown in the drawing), and the thus obtained signals are transmitted to the regulating unit 72 of FIG. 2 for admission of additional air from a source by way of the air withdrawing unit 73 which cooperates with the additional air drawing unit 37.

Since the transporting of tobacco particles by air in the tobacco stream building unit including the conveyors 41 necessitates the utilization of a certain quantity of air which is being drawn from the chamber or compartment 36, and since the orifices 68, 69, 71 of compressed air nozzles deliver a lesser quantity of air, while the cover 39 of the chamber or compartment 36 permits a certain quantity of dust-laden air to escape into a dust-removing unit 74 (see FIG. 2) and the latter admits the thus cleaned air into the blower 38 of the second air circulating system 37, air issuing from the dust-removing unit 74 also flows into the axial cyclone 67, and a further connection 76 to the atmosphere admits additional air into the chamber or compartment 36 to thus establish a further compensating air stream.

The reference characters 77, 78, 79 and 81 denote (in FIG. 2) additional regulating units which serve to establish and to maintain optimal flow conditions in various parts of the distributor D, and the reference characters 82, 83, 84, 86 and 87 denote means (such as dials) for indicating air pressures at various locations in the distributor D of FIGS. 1 to 3.

An advantage of the feature that the metering device (including the gathering duct 27) is located upstream (such as immediately upstream) of the concave surfaces of the guides 33, 34 and downstream of the sifter 12 (as seen in the direction of advancement of the satisfactory constituents, primarily or even exclusively tobacco shreds) from the inlet of the distributor D (i.e., from the gate 1) toward the underside(s) of the foraminous belt conveyor(s) 41 is that this ensures a highly accurate metering of the satisfactory constituent which is to reach the guide 33 and/or 34 independently of the composition of the mixture being fed to the gate 1 (i.e., independently of the percentage of tobacco shreds, tobacco ribs and/or impurities, e.g., metallic particles, soil and/or other undesirable substances). As already pointed out hereinbefore, the utilization of an at least substantially upright pneumatic zig-zag sifter even further enhances uninterruped and optimal segregation of satisfactory constituents from other constituents. Moreover, the operation of the distributor D is enhanced, even further and to a considerable degree, in that it embodies the separator 16 which operates downstream of the outlet of the sifter for the satisfactory constituent (i.e., downstream of the upper end of the illustrated zig-zag sifter 12). Such arrangement contributes to the building of a homogeneous air-shred mixture which flows from the expelling roller 31 toward the concave upper side of the guide 33. Additional advantageous features include the utilization of a metering device 27 having a vibratory outlet 29 adjacent the expelling means including the cooperating rotary parts 31, 32.

Integration of the zig-zag sifter 12 and of the Coanda separator 16 into the air circulating system 14 having the aforementioned frequency-regulated rotary blower 13 ensures highly satisfactory separation of desirable constituents from air so that the thus cleaned air can be reused in the improved distributor. The air can be retained in the distributor and circulated via elbow 17 and parts 19, 21 with the consumption of small amounts of energy; this also contributes to the advantages of the distributor D by ensuring a satisfactory air balancing at a low cost.

The efficiency of the zig-zag sifter 12 can be enhanced by increasing the number of its sections or stages. However, the number of such stages cannot be increased at will because this would necessitate an increase of the overall dimensions (particularly height) of the distributor D. The provision of the additional pneumatic (follow-up) sifter 43, which is installed below the lowermost stage 44 of the zig-zag sifter 12, renders it possible to enhance the efficiency of the combined sifter without increasing (or unduly increasing) the height of the sifter 12. The follow-up sifter 43 ensures that tobacco shreds which might have been entrained by the ribs descending into and below the lowermost stage 44 are returned into the main path for the flow of air in the sifter 12.

The follow-up sifter 43 can be operated in a simple, efficient and inexpensive manner in that it is connected with the air circulating system 37 (refer again to FIG. 2), i.e., with the system which supplies air to the orifices 68, 69 and 71 in the concave upper side or surface of the guide 34.

Figure 4:
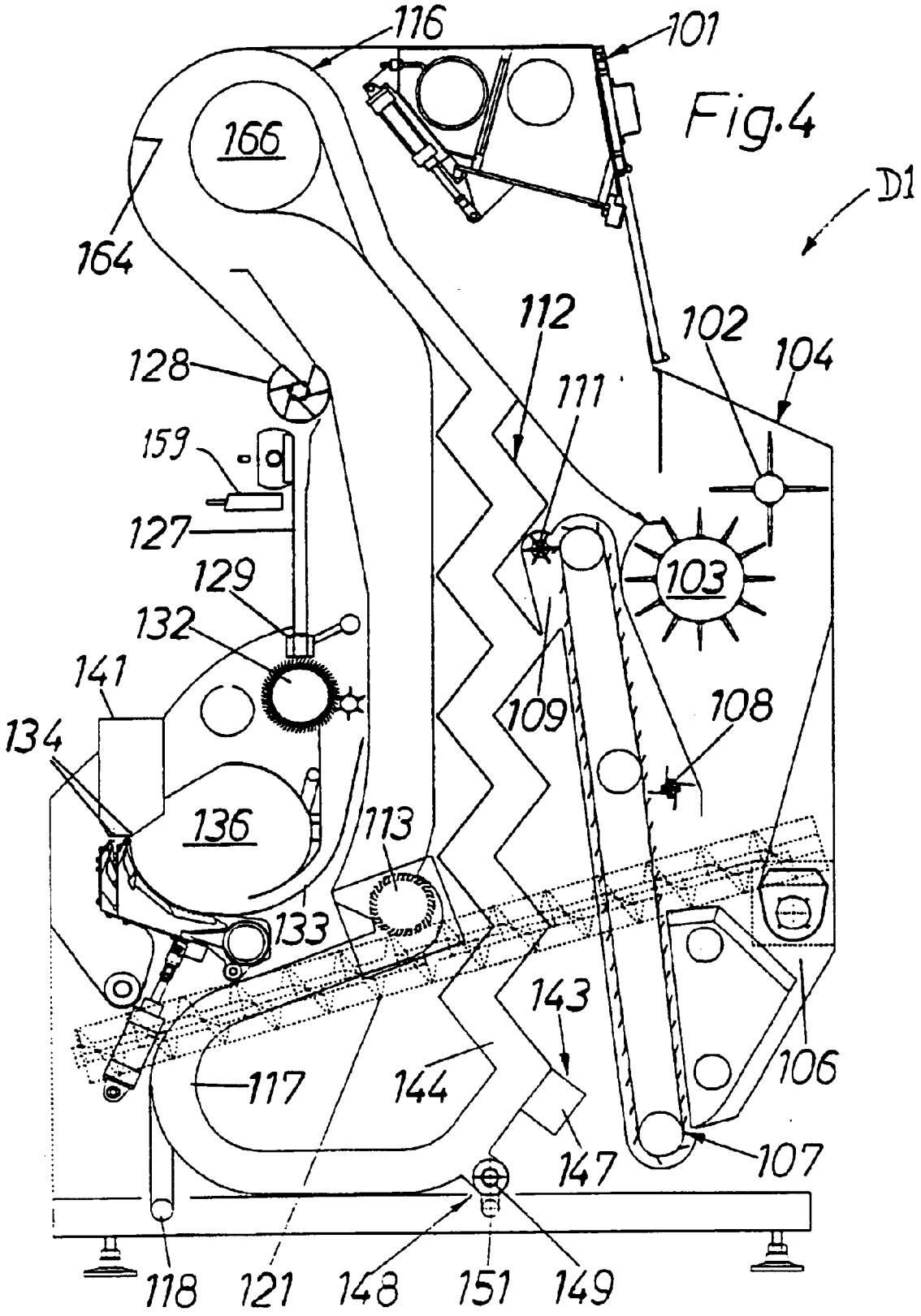
FIG. 4 is a schematic substantially vertical sectional view of a modified distributor.

FIG. 4 illustrates certain features of a modified distributor D1. All such component parts of the distributor D1 which are identical with or analogous to those of the distributor D shown in FIGS. 1 to 3 are denoted by similar reference characters plus 100.

The feeding roller 7 of the distributor D is replaced with a so-called elevator belt or chain conveyor 107 (hereinafter called elevator conveyor for short) which draws batches of a mixture of tobacco shreds and tobacco ribs from the reservoir 106 and has longitudinally spaced-apart paddles which advance the withdrawn batches upwardly and into the range of the singularizing roller 111. The latter propels the batches into the feeding duct 109 which discharges into the zig-zag sifter 112 at a level somewhat above the median sections or stages of the sifter.

A feed screw 121 is employed to return the removed surplus tobacco from the trimming or equalizing station(s) at the foraminous belt conveyor(s) 141 into the reservoir 106 for renewed admission into the zig-zag sifter 112 by way of the elevator conveyor 107, singularizing roller 111 and feeding duct 109.

The speed of the elevator conveyor 107 can be regulated in dependency upon the height of the supply of tobacco in the gathering duct 127 (e.g., by resorting to a level monitoring device corresponding to the device 59 shown in FIG. 3 adjacent to the duct 27 of the metering device in the distributor D).

An advantage of the distributor D1 of FIG. 4 is that it is even more compact than the distributor D of FIGS. 1 to 3. Furthermore, it has been found that the sifting action of the zig-zag sifter 112 is highly satisfactory if the elevator conveyor 107 delivers batches of a mixture of tobacco ribs and tobacco shreds into one or more sections or stages at a level above the middle of the upright or substantially upright zig-zag sifter 112. Moreover, the elevator conveyor 107 can deliver into an upper stage of the sifter 112 those tobacco ribs and tobacco shreds which the reservoir 106 receives from the gate 101 via hopper 104 as well as those tobacco particles (normally tobacco shreds or primarily tobacco shreds) which are fed into the reservoir 106 by the feed screw 121 and come from the trimming or equalizing station(s) adjacent the foraminous belt conveyor(s) 141. All that is necessary is to ensure that the capacity of the reservoir 106 suffices to receive fresh mixture of tobacco shreds and tobacco ribs from the gate 101 and the hopper 104 as well as trimmed off tobacco particles from the feed screw 121.

An advantage which is common to all embodiments of the improved distributor is that the energy requirements for proper operation of the monitoring and regulating or adjusting units are low, that its space requirements do not exceed and can be much less than those of conventional distributors, that its air balance is uniform, and that its ability to segregate foreign particles from tobacco particles as well as to segregate more desirable tobacco particles from the less desirable tobacco particles is superior to that of presently known distributors. Still further, the improved distributor can furnish highly satisfactory results even if the composition of the mixture which is being furnished to the hopper 4 or 104 by the gate 1 or 101 or in another way varies within a wide range. This is of great importance because the improved distributor can ensure the making of one or more continuous high-quality rod-like tobacco fillers even if its gate 1 or 101 is called upon to deliver batches containing widely different percentages of tobacco ribs, tobacco shreds, tobacco dust and/or other substances which may or may not be acceptable in the rod-like fillers of smokers' products. Otherwise stated, the quality of the ultimate products is affected by the composition of the material being supplied to the distributor D or D1 or any other distributor embodying the present invention to an extent well below that which can be expected by resorting to conventional distributors.

The improved distributor D or D1 is believed to be the first apparatus of such character wherein the guide or guides (such as 33, 34 or 133, 134) receives or receive acceptable constituents of tobacco leaves (this term is intended to encompass natural, artificial substitute and reconstituted tobacco) from a reservoir (such as 6 or 106) by way of a zig-zag sifter (12 or 112), a separator (such as the Coanda separator 16 or 116) and a metering device (such as the one including the gathering duct 27 or 127) in that order, and wherein the sifter and the separator are embodied in an air circulating system (such as 14 or the one embodied in the distributor D1). An advantage of such arrangement is that it achieves an optimal segregation of satisfactory constituents (such as shreds of tobacco leaf laminae) from less satisfactory constituents (particularly or primarily too large, too hard or otherwise inferior parts of tobacco ribs), i.e., segregation of the satisfactory constituents from less satisfactory or unacceptable constituents of the mixture, at an early stage of the advancement through the distributor to thus ensure highly accurate, predictable and reproducible operation of the metering device 27 or 127. The result is the production of high-quality smokers' products as well as the utilization of a very high percentage of satisfactory constituents of the mixture which is being supplied to the gate (such as 1 or 101) of the improved distributor.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of the above outlined contribution to the art of apparatus for building tobacco rods in cigarette making machines and, therefore, such adaptations should and are intended to be comprehended within the meaning and range of equivalence of the appended claims.

What is claimed is:

1. Apparatus for building at least one rod-like filler containing at least one constituent of a mixture of smokable particulate materials and being pneumatically delivered to at least one foraminous conveyor, comprising:

means for supplying the at least one constituent to the foraminous conveyor, including at least one guide having a surface defining a path for advancement of the at least one constituent to the foraminous conveyor;

a metering device arranged to supply the at least one constituent into said path; and a sifter arranged to supply the at least one constituent and air toward said metering device, wherein said metering device includes a duct and said sifter includes an at least substantially upright zig-zag sifter.

2. The apparatus of claim 1, wherein said zig-zag sifter comprises a plurality of stages including a lowermost stage, and a pneumatic follow-up sifter beneath said lowermost stage, said follow-up sifter having an air box and a sieve separating said air box from said lowermost stage.

3. The apparatus of claim 2, further comprising an air circulating system which is connected with said follow-up sifter and discharges air into said path.

4. The apparatus of claim 1, wherein said duct includes a vibrating outlet arranged to discharge the at least one constituent for delivery into said path and at least one rotary withdrawing member arranged to direct the at least one constituent from said outlet into said path, and further comprising an air separator interposed between the sifter and an inlet of the duct.

5. The apparatus of claim 4, wherein said separator includes a Coanda separator.

6. The apparatus of claim 5, further comprising an air circulating system including a frequency-regulated transverse air stream generating blower, said sifter and said Coanda separator constituting integral parts of said air circulating system.

7. The apparatus of claim 6, wherein said air circulating system is arranged to direct a stream of air in a predetermined direction and further includes an air bypass disposed downstream of said blower, as seen in said predetermined direction.

8. The apparatus of claim 7, wherein said air circulating system further comprises an air-conveying elbow having radially inner and radially outer portions, said air bypass receiving air from the radially outer portion of said elbow.

9. Apparatus for building at least one rod-like filler containing at least one constituent of a mixture of smokable particulate materials and being pneumatically delivered to at least one foraminous conveyor, comprising:

means for supplying the at least one constituent to the foraminous conveyor, including at least one guide having a surface defining a path for advancement of the at least one constituent to the foraminous conveyor;

a metering device arranged to supply the at least one constituent into said path; and a sifter arranged to supply the at least one constituent and air toward said metering device, wherein said sifter includes an at least substantially upright zig-zag sifter having a plurality of stages including a lower-most stage, a pneumatic follow-up sifter beneath said lowermost stage, and a rotary picker roller disposed opposite said follow-up sifter and arranged to break up coherent accumulations—if any—of the mixture of smokable particulate materials in said zig-zag sifter.

10. Apparatus for building at least one rod-like filler containing at least one constituent of a mixture of smokable particulate materials and being pneumatically delivered to at least one foraminous conveyor, comprising:

means for supplying the at least one constituent to the foraminous conveyor, including at least one guide having a surface defining a path for advancement of the at least one constituent to the foraminous conveyor;

a metering device arranged to supply the at least one constituent into said path; and a sifter arranged to supply the at least one constituent and air toward said metering device, wherein said metering device is arranged to supply the at least one constituent with a surplus which is removed at said at least one foraminous conveyor, said sifter including an at least substantially upright zig-zag sifter having a plurality of stages including an uppermost stage, and further comprising a pneumatic return conduit for delivery of the removed surplus into the sifter at said uppermost stage thereof.

11. The apparatus of claim 10, further comprising an air circulating system including a transverse air stream generating blower, said sifter forming part of said air circulating system and said system further including an elbow haying radially inner and radially outer portions, said radially inner portion of said elbow being arranged to supply air to said pneumatic return conduit.

12. Apparatus for building at least one rod-like filler containing at least one constituent of a mixture of smokable particulate materials and being pneumatically delivered to at least one foraminous conveyor, comprising:

means for supplying the at least one constituent to the foraminous conveyor, including at least one guide having a surface defining a path for advancement of the at least one constituent to the foraminous conveyor;

a metering device arranged to supply the at least one constituent into said path; and a sifter arranged to supply the at least one constituent and air toward said metering device, wherein said sifter is an at last substantially upright pneumatic zig-zag sifter having a plurality of stages disposed at different levels and including a substantially median stage, said zig-zag sifter further having an inlet and further comprising a duct having an inlet and an outlet, said inlet communicating with said median stage and said duct being arranged to direct the mixture downwardly, and further comprising a reservoir for the mixture and a rotary carded feeding roller arranged to supply mixture from said reservoir into the inlet of said duct.

13. Apparatus for building at least one rod-like filler containing at least one constituent of a mixture of smokable particulate materials and being pneumatically delivered to at least one foraminous conveyor, comprising:

means for supplying the at least one constituent to the foraminous conveyor, including at least one guide having a surface defining a path for advancement of the at least one constituent to the foraminous conveyor;

a metering device arranged to supply the at least one constituent into said path;

a sifter arranged to supply the at least one constituent and air toward said metering device; and an air circulating system including a transverse air stream generating rotary blower, said sifter constituting a multistage zig-zag sifter forming an integral part of said system and having an uppermost stage and a lowermost stage, and further comprising means for regulating the rotational speed of said blower in dependency upon changes of a pressure differential existing between air in the uppermost and lowermost stages of said zig-zag sifter.

14. The apparatus of claim 13, wherein said regulating means comprises a first signal generating pressure sensor at a level above the uppermost stage of said zig-zag sifter, a second signal generating pressure sensor at the level of the lowermost stage of said zig-zag sifter, and means for comparing the signals from said sensors.

15. Apparatus for building at least one rod-like filler containing at least one constituent of a mixture of smokable particulate materials and being pneumatically delivered to at least one foraminous conveyor, comprising:

means for supplying the at least one constituent to the foraminous conveyor, including at least one guide having a surface defining a path for advancement of the at least one constituent to the foraminous conveyor;

a metering device arranged to supply the at least one constituent into said path;

a sifter arranged to supply the at least one constituent and air toward said metering device; and means for monitoring the quantity of the at least one constituent in said metering device, a magazine for the mixture, and means for feeding the mixture from said magazine into said sifter at a rate depending upon the quantity of the at least one constituent in said metering device.

16. Apparatus for building at least one rod-like filler containing at least one constituent of a mixture of smokable particulate materials and being pneumatically delivered to at least one foraminous conveyor, comprising:

means for supplying the at least one constituent to the foraminous conveyor, including at least one guide having a surface defining a path for advancement of the at least one constituent to the foraminous conveyor;

a metering device arranged to supply the at least one constituent into said path; and a sifter arranged to supply the at least one constituent and air toward said metering device, wherein said sifter includes an at least substantially upright zig-zag sifter and further comprising a magazine for a supply of the mixture and an elevator conveyor arranged to supply mixture from said magazine into said zig-zag sifter.

17. The apparatus of claim 16, wherein said zig-zag sifter includes a median portion and said elevator conveyor is arranged to supply mixture into said zig-zag sifter at a level above said median portion thereof.

18. The apparatus of claim 16, wherein said metering device is arranged to supply the at least one constituent with a surplus which is removed at said at least one foraminous conveyor, and further comprising at least one feed screw arranged to return the removed surplus into said magazine.

19. The apparatus of claim 16, further comprising means for monitoring the quantity of the at least one constituent in said metering device and means for driving said elevator conveyor at a speed which is a function of the monitored quantity of the at least one constituent in said metering device.

* * * * *